United States Patent [19]

Thomas

[11] Patent Number: 4,513,186

[45] Date of Patent: Apr. 23, 1985

[54] VACUUM INTERRUPTER CONTACT STRUCTURE AND METHOD OF FABRICATION

[75] Inventor: Robert L. Thomas, Big Flats, N.Y.

[73] Assignee: Westinghouse Electric Corp., Pittsburgh, Pa.

[21] Appl. No.: 452,263

[22] Filed: Dec. 22, 1982

[51] Int. Cl.[3] ..... H01H 33/66

[52] U.S. Cl. ..... 200/144 B; 200/262; 200/265; 200/267; 200/268

[58] Field of Search ..... 200/144 B, 262–270

[56] References Cited

U.S. PATENT DOCUMENTS 3,711,665 1/1973 Dethlefsen ..... 200/144 B
4,077,114 3/1978 Sakuma ..... 200/144 B
4,190,753 2/1980 Gainer ..... 200/144 B
4,419,551 12/1983 Kato ..... 200/144 B

*Primary Examiner*—Robert S. Macon
*Attorney, Agent, or Firm*—W. G. Sutcliff

[57] ABSTRACT

An electrical contact member and method of fabrication which facilitates braze connection of the electrical contact member to the conductive support stem of a vacuum interrupter structure. A high density slug of the contact material is performed. The high density slug is disposed in a powder mass of the contact material which is sintered to form the contact member. A high conductivity component is then infiltrated in the electrical contact member to produce the desired conductivity for the contact member, with the high density portion being easily brazed to a conductive support stem.

6 Claims, 3 Drawing Figures

VACUUM INTERRUPTER CONTACT STRUCTURE AND METHOD OF FABRICATION

BACKGROUND OF THE INVENTION

The present invention relates to vacuum interrupter electrical contacts and a method of fabrication. A vacuum interrupter is a circuit protection device and comprises a sealed envelope with movable contacts disposed within the envelope for making and breaking electrical continuity. The electrical contact structures enclosed within the envelope must carry very large current efficiently and have a low resistance value when the contacts are in the closed or current-carrying position. When the electrical contacts are separated, some of the contact material is vaporized and the contact materials are selected to minimize erosion of the contacts upon separation or arcing.

A widely used contact material used in vacuum interrupters is described in U.S. Pat. No. 3,818,163, are a chromium matrix contact which is infiltrated with copper. Such chromium-copper contacts provide the low resistive value, and high current-carrying capability desired for such contacts, and also the anti-weld and arcing erosion resistance necessary for long life. High density chromium-copper contact materials and method of fabrication are set forth in U.S. Pat. Nos. 4,032,301 and 4,190,753.

The electrical contacts of the vacuum interrupter are supported within the sealed envelope by a conductive support rod or stem which is typically copper. This copper support rod or stem must be electrically connected to the back surface of the electrical contact during fabrication, and this is typically done by brazing. In fabricating large diameter chromium-copper contacts, it has been found difficult to achieve a uniform porosity in the fabricated contact. Areas of high porosity are typically produced in the central portion, and the back surface of the central portion of the contact must be brazed to the support stem. These areas of high porosity can absorb the braze material into the contact structure creating a poor contact-to-stem braze connection. The electrical contacts of a vacuum interrupter are subjected to significant impact forces upon contact closure and the integrity of the braze between the support stem and the contact is critical in withstanding this impact force.

Other contact materials have been used in vacuum interrupters, and it is common to include a high temperature resistance metal or alloy as one component, and a high conductivity metal as a second component. Such a contact is tungsten or tungsten carbide, as the high temperature resistant component, and copper or silver as the high conductivity component.

SUMMARY OF THE INVENTION

A vacuum interrupter electrical contact structure and method of fabrication is disclosed which permits a reliable high-quality braze contact to be made between a conductive support stem and the electrical contact of the present invention. The electrical contact comprises a generally disk-like member which comprises a high temperature resistant, conductive first component, and a high conductivity second component. The contact is fabricated with a selected density for the contact body arc contact surface portion, and a predetermined higher density contact portion is provided at the central back surface portion, and extending into the contact disk to permit brazing of this higher density contact portion to a supporting copper stem. In the preferred embodiment the contact is a chromium-copper member. A predetermined high density, disk-like slug of admixed chromium and copper is first formed and densified. This densified slug is then disposed with a body of chromium powder within a contact forming vessel. The chromium powder with embedded slug is then sintered to form the electrical contact preform with the inclusion of the high density contact portion. Copper is then infiltrated into the sinter-formed electrical preform to establish the desired copper concentration at the arc contact surface with the higher density contact portion provided at the central back surface of the electrical contact which is brazed to the copper support stem.

DESCRIPTION OF THE PREFERRED EMBODIMENT

Figure 1:
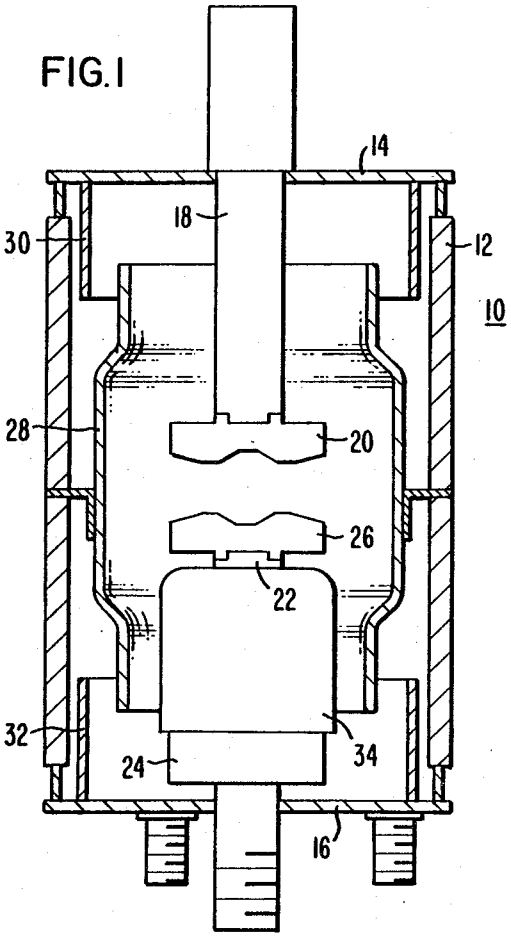
FIG. 1 is an elevational view partly in section of the vacuum interrupter assembly.

The vacuum interrupter device 10 seen in FIG. 1 comprises a generally cylindrical insulating body portion 12, having sealed end members 14 and 16 at opposed ends of the body 12. A conductive support rod or stem 18 is brought through end member 14 and electrical contact member 20 is disposed at the terminal end of conductive stem 18. Another conductive support rod or stem 22 is brought through the opposed end member 16 and a bellows member 24 which permits movement of the stem 22. An electrical contact member 26 is supported at the terminal end of the support stem 22 as will be described in detail. A plurality of vapor shields 28, 30, and 32 are provided within the sealed envelope 12 about the contacts. A shield member 34 is also provided about the bellows 24.

The chromium-copper electrical contacts 20 and 26 can be simple disk-like members, but will more typically include a plurality of spirally directed arms for producing a circular arc driving force, which serves to keep the arc which forms upon contact separation in motion, and to minimize localized heating of the contact surface.

Figure 2:
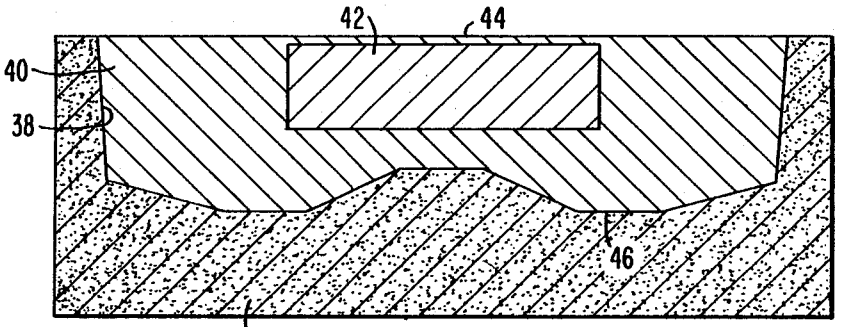
FIG. 2 is a side-elevational view in section of a sintering fixture or vessel filled with chromium powder and the pressed high density chromium-copper slug utilized in the present invention.

An improved electrical contact structure 20 and 26 and method of fabrication is provided by the present invention. The method of fabrication and contact structure can be best appreciated by reference to FIGS. 2 and 3. In FIG. 2 a high-temperature resistant, refractory fabrication vessel 36 includes a contact defining volume 38 which is filled with finely divided chromium powder 40. A pressed, high density 90% chromium-10% copper slug 42 is seen embedded in the chromium powder near the top surface 44 of the chromium powder disposed within the vessel 36. This top surface 44 is, in fact, the back surface of the fabricated electrical contact and is the surface which is brazed to the copper conductive stem. The opposed surface 46 is the arc contact surface of the electrical contact. The high density pressed slug 42 is formed by blending approximately 10 weight percent copper powder with 90 weight percent chromium powder, and pressing to a density of about 83 percent of theoretical density. For an electrical contact which has a 4-inch nominal diameter, the pressed high density slug is typically about 2 inches in diameter and about 0.5 inch thick. The chromium powder covers the embedded high density slug 42, and a thickness of about 0.20 inch of chromium powder covers the slug 42 at the top surface 44. The chromium powder with embedded slug is tamped in an arbor press and the vessel is heated in a vacuum sintering furnace at about 1250° C. for about 4 hours. Following the vacuum sintering operation, the sintered contact is removed from the vessel 36 and copper is infiltrated into the sintered chromium matrix. This copper infiltration is a well-known technique described in the aforementioned U.S. Pat. No. 3,818,163 with the sintered matrix contact heated while in contact with a copper body which is infiltrated into the chromium matrix.

Figure 3:
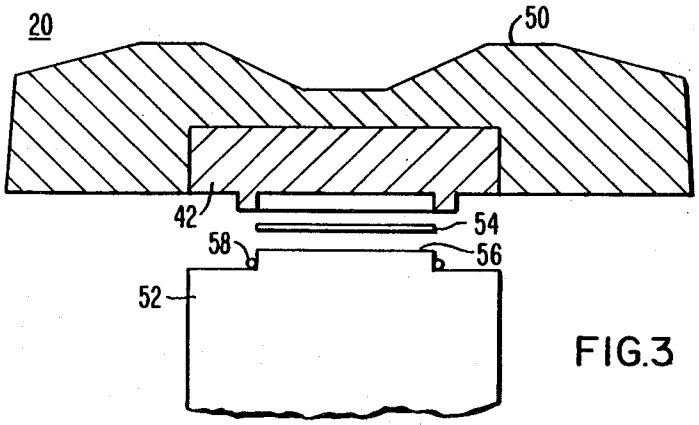
FIG. 3 is an elevational view partly in section of the electrical contact of the present invention shown spaced apart from the conductive copper contact stem or conductive support stem prior to final assembly via brazing.

As seen in FIG. 3, the completed electrical contact 20 retains a high density 48 at the back surface and extends into the contact a predetermined distance depending upon the slug dimensions. The amount of copper which is infiltrated into the chromium matrix can be varied widely. In a typical example, the copper content in the infiltrated completed contact is about 55% copper for the arcing portions of the contact, while it is about 27% copper in the high density slug portion of the formed contact. The higher density of the slug prevents as effective infiltration of the copper into the high density slug portion as opposed to the remaining portion of the electrical contact.

As seen in FIG. 3, the back surface of the electrical contact 20 is machined away and an annular rim 50 is formed in the high density portion 42 to accept the copper support 52 therein. This rim 50 is formed in the high density portion of the contact and a disk 54 of braze material is disposed between the reduced diameter terminating end 56 of the copper stem 52 and the high density contact portion 42 during final braze fabrication. A braze ring 58 is also disposed about the copper stem and forms a braze fillet between the stem and the annular rim portion.

The braze bonding between the copper support stem and the high density portion of the electrical contact has been found to be easily made is structural stable. The specific density value given in the preferred example, and the copper percentages provided in both the preformed slug and in the final fabricated electrical contact can be readily varied. The small percentage of copper in forming the preformed slug is merely sufficient to provide sufficient binding strength for the chromium powder which is pressed to the desired density. The preformed slug density is sufficient to provide a rigid slug which will maintain its integrity and is also sufficiently dense compared to the chromium powder to provide preferential infiltration into the remaining portions of the chromium powder while retaining the high density characteristic of the slug.

What is claimed is:

1. An electrical contact member for use in a vacuum interrupter, which contact member is electrically connectable by brazing to a conductive support stem, which contact member comprises a generally disk-like member of high temperature resistant chromium matrix material infiltrated with high conductivity copper, and comprises a predetermined density arc contact portion with a relatively high weight percentage of high conductivity copper and a higher density central back contact portion adapted to be brazed to the conductive contact support stem, which higher density central back contact portion contains about half the weight percentage of high conductivity copper as does the arc contact portion.

2. The electrical contact member set forth in claim 1, wherein the copper content in the higher density contact portion is about 27 weight percent, and the copper content of the remainder of the electrical contact is about 55 weight percent.

3. Method of fabricating an electrical contact member for use in a vacuum interrupter, wherein the electrical contact member is comprised of a high temperature resistant first component and a high conductivity second component, and which electrical contact member is generally disk-like with an arcing surface on one side and the opposed side is braze connectable to a conductive support stem, which method comprises:

(a) forming a high density disk-like slug from admixed powder of a high temperature resistant conductive first component and a high conductivity second component;

(b) disposing the high density disk-like slug within a body of powder of the high temperature resistant, conductive first component within a contact forming vessel, with the slug being closely spaced from one surface of the powder;

(c) sintering the slug and powder in the vessel to form the electrical contact member having a high density portion formed from the slug;

(d) infiltrating the high conductivity second component into the sinter formed electrical contact to establish the desired concentration of high conductivity second component in the less dense portion of the electrical contact.

4. The method of fabrication set forth in claim 3, wherein the first component is chromium and the second component is copper.

5. The method of fabrication set forth in claim 4, wherein the weight ratio of chromium to copper in the disk-like slug is about 90 to 10, and the density of the slug is about 83 percent of the theoretical maximum density.

6. The method of fabrication set forth in claim 4, wherein the amount of copper infiltrated into the sinter formed electrical contact is such that the copper comprises about 55 weight percent of the less dense portion of the electrical contact, and the copper comprises about 27 weight percent of the higher density portion which is thereafter braze-joined to a copper support stem.

* * * * *